US005917412A

United States Patent [19]

Martin

[11] Patent Number: 5,917,412

[45] Date of Patent: Jun. 29, 1999

[54] DEACTIVATION DEVICE WITH BIPLANAR DEACTIVATION

[75] Inventor: Wayne H. Martin, Boca Raton, Fla.

[73] Assignee: Sensormatic Electronics Corporation, Boca Raton, Fla.

[21] Appl. No.: 08/859,059

[22] Filed: May 21, 1997

[51] Int. Cl.[6] ..... G08B 13/14

[52] U.S. Cl. ..... 340/572.3; 340/572.6; 340/572.7; 343/742

[58] Field of Search ..... 340/572, 551, 340/572.3, 572.6, 572.7; 335/284; 343/741, 742, 866, 867

[56] References Cited

U.S. PATENT DOCUMENTS

| | | | |
|---|---|---|---|
| 3,781,661 | 12/1973 | Trikilis | 340/572 |
| 4,309,697 | 1/1982 | Weaver | 340/572 |
| 4,510,489 | 4/1985 | Anderson, III et al. | 340/572 |
| 4,574,274 | 3/1986 | Pinneo | 340/572 |
| 4,658,263 | 4/1987 | Urbanski | 343/788 |
| 4,675,655 | 6/1987 | Anderson et al. | 340/505 |
| 4,686,515 | 8/1987 | Anderson et al. | 340/572 |
| 4,752,758 | 6/1988 | Heltemes | 335/284 |
| 4,857,893 | 8/1989 | Carroll | 340/572 |
| 4,890,115 | 12/1989 | Hartings | 343/742 |
| 4,992,776 | 2/1991 | Crossfield | 340/572 X |
| 5,126,720 | 6/1992 | Zhou et al. | 340/572 |
| 5,142,292 | 8/1992 | Chang | 343/742 |
| 5,170,045 | 12/1992 | Bengtsson | 235/462 |
| 5,172,461 | 12/1992 | Pichl | 340/572 X |
| 5,341,125 | 8/1994 | Plonsky et al. | 340/572 |
| 5,442,334 | 8/1995 | Gallo et al. | 340/572 |
| 5,469,142 | 11/1995 | Bergman et al. | 340/572 |
| 5,477,202 | 12/1995 | Zarembo et al. | 335/284 |
| 5,493,275 | 2/1996 | Easter | 340/572 |
| 5,534,836 | 7/1996 | Schenkel et al. | 335/284 |
| 5,594,420 | 1/1997 | Copeland et al. | 340/572 |

*Primary Examiner*—Thomas Mullen
*Attorney, Agent, or Firm*—Robin, Blecker & Daley

[57] ABSTRACT

A deactivation device for use in deactivating electronic article surveillance ("EAS") tags includes a deactivating coil having first and second coil parts. The first coil part is positioned in angular adjacent relation to the second coil part so that the coil parts are adapted to transmit simultaneously a deactivating field. The deactivating field forms a deactivation zone having a configuration which permits for deactivation of an active EAS tag when the active EAS tag is situated within the deactivation zone.

44 Claims, 7 Drawing Sheets

DEACTIVATION DEVICE WITH BIPLANAR DEACTIVATION

FIELD OF THE INVENTION

This invention relates generally to deactivation devices for use in electronic article surveillance ("EAS") systems and pertains more particularly to a deactivation device with biplanar deactivation for deactivating EAS tags or labels used in EAS systems.

BACKGROUND OF THE INVENTION

In current EAS systems, EAS tags or labels are applied to articles and are detectable by an EAS system if unauthorized removal of an article with an activated EAS tag is attempted. One type of EAS tag comprises a length of amorphous magnetic material which is positioned substantially parallel to a length of magnetizable material used as a control element. When an active tag, i.e., one having a magnetized control element, is placed in an alternating magnetic field, which defines an interrogation zone, the tag produces a detectable valid tag signal. When the tag is deactivated by demagnetizing its control element, the tag no longer produces the detectable tag signal. Such deactivation of the tag, can occur, for example, when an employee of a retail establishment passes an EAS tagged article over a deactivation device at a checkout counter thereby deactivating the tag.

Generally, deactivation devices of tags include a coil structure energizable to generate a magnetic field of a magnitude sufficient to render the tag "inactive." In other words, the tag is no longer responsive to incident energy applied thereto to provide an output alarm or to transmit an alarm condition to an alarm unit external to the tag.

Examples of deactivation devices include those sold under the trademarks Speed Station® and Rapid Pad® commercially available from the assignee, Sensormatic Electronics Corporation of Boca Raton, Fla. The Rapid Pad® deactivator, which generates a magnetic field when a tag is detected, has a single or planar coil disposed horizontally within a housing. Deactivation occurs when the tag is detected moving horizontally across in a coplanar disposition and within a four inch proximity of the top surface of the housing located on top of a check-out counter.

The Speed Station® deactivator has a housing with six coils orthogonally positioned therein to form a "bucket-like" configuration. An employee inserts an article or plurality of articles into the open side of the bucket. The employee then deactivates the inserted articles by manually triggering the deactivator.

The Speed Station® deactivator includes six coils divided into three coil pairs, which are disposed about the bucket in respective x, y and z-axis planes. The coils of each coil pair are positioned parallel to one another and the coil pairs are driven one pair at a time in sequence resulting in a three step sequence for deactivation of an EAS tag. Because the coils are in three planes, orientation of the tag with respect to the coils is not required, however, the tag needs to be inserted inside the cavity of the bucket to permit deactivation.

The above-described deactivators are limited in their usefulness in that the deactivation zone or area for deactivating the EAS tags is restricted to the area and height of the planar coil configuration of each deactivator. For example, when using the Rapid Pad® deactivator, the deactivation zone for deactivating a tag exists only in a horizontal or coplanar direction and within a four inch proximity from the top surface of the housing of the deactivator. This requires the operator to make sure that the tag is within close proximity to the surface of the Rapid Pad® deactivator to ensure that the tag is deactivated. With respect to the Speed Station® deactivator, its deactivation zone exists only inside of its "bucket" configuration, thus requiring the tag to be inserted therein.

Because of the limited range or area of the deactivation zone of each device, deactivation of a tag attached to an article is sometimes ineffective if the tag has not been properly positioned in relation to the deactivator being used. This can result in false alarming of the EAS system which is undesirable.

It is therefore an object of the present invention to provide an improved deactivation device for deactivating EAS tags.

It is a further object of the present invention to provide a deactivation device which increases and extends the deactivation area or zone in which EAS tags can be deactivated.

It is additional object of the present invention to provide a deactivation device which is simple and easy to use in order to deactivate EAS tags.

SUMMARY OF THE INVENTION

In accordance with the principles of the present invention, the above and other objectives are realized in a deactivation device for use in deactivating EAS tags which comprises a deactivating coil having first and second coil parts. The first coil part is positioned in angular adjacent relation to the second coil part and the coil parts are adapted to transmit simultaneously a deactivating field. The deactivating field forms a deactivation zone having a configuration which permits for deactivation of the active EAS tag when the active EAS tag is situated within the deactivation zone.

In the embodiment of the invention to be disclosed hereinafter, the first and second coil parts of the deactivating coil are separate and independent coils located in a housing. The first coil part is positioned in a side section of the housing and forms an angle in the range of 45° to 135° with respect to the plane of the second coil part located in an adjacent bottom section of the housing.

Based upon this configuration, an active EAS tag is deactivated when placed in proximity to the deactivation device and when a deactivating field is then transmitted simultaneously from the first and second coil parts. The deactivation device of the present invention provides a larger area or zone in which an operator can place an active EAS tag for deactivation as well as the ability to orient the tag in any variety of directions to enable deactivation in the zone formed by the device.

In a modified form of the deactivation device of the present invention, the deactivating coil is a coil which has been bent to define side and bottom sections forming the first and second adjacent coil parts, respectively. The bent coil configuration also provides a larger deactivation zone and the ability to orient an active EAS tag in any variety of directions to enable deactivation within the zone.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
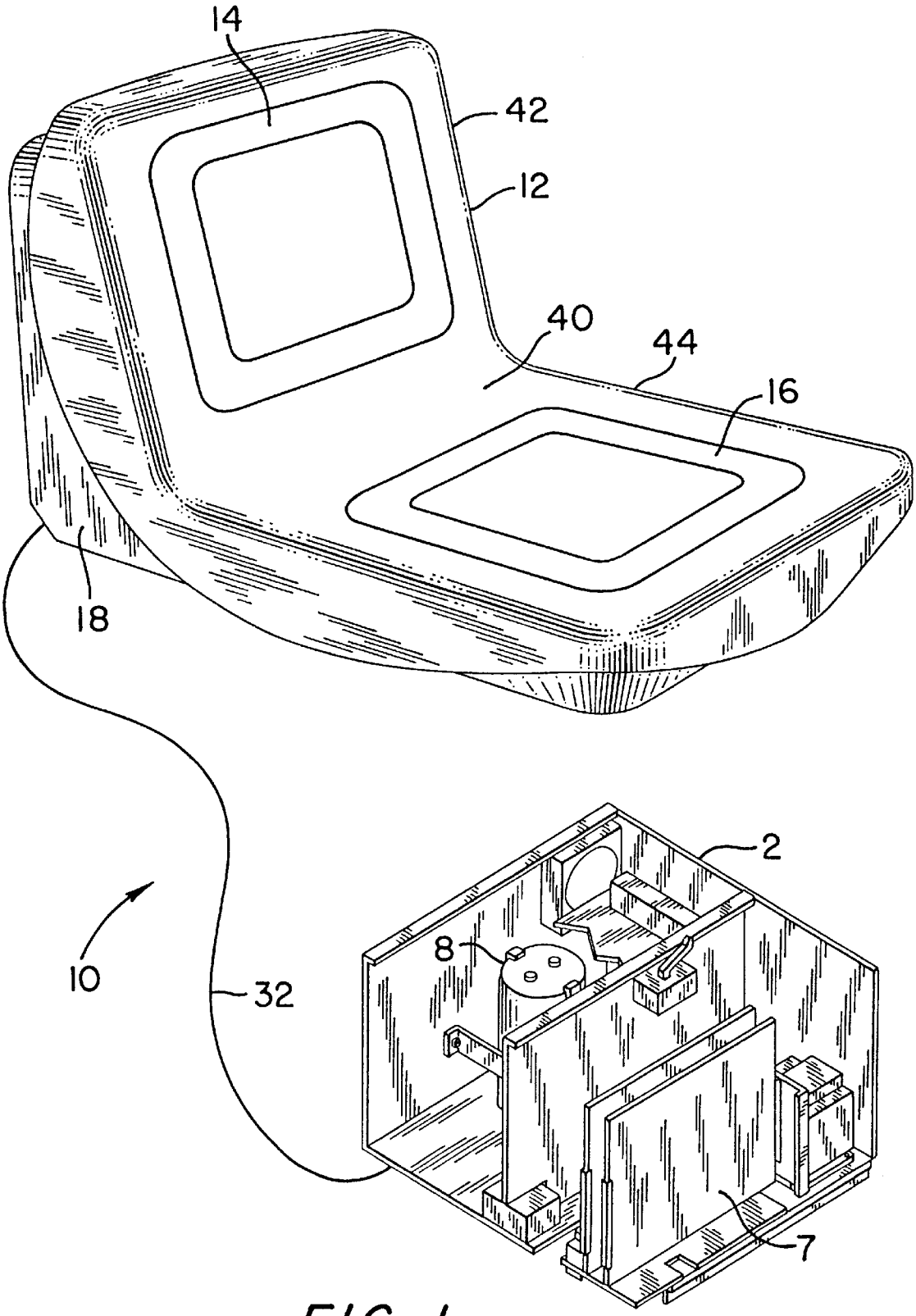
FIG. 1 shows a view of a deactivation device in accordance with-the principles of the present invention.

A deactivation device 10 of the present invention, as illustrated in FIG. 1, is used for deactivating active EAS tags used in an EAS system. The deactivation device 10 permits deactivation of EAS tags by increasing the overall deactivation area or zone in which the tags can be deactivated. The deactivation device 10 also allows the EAS tags to be oriented in any variety of directions in the deactivation zone and still be deactivated.

As illustrated in FIG. 1, the deactivation device 10 of the present invention comprises a deactivator unit 12 and an energizing or power source unit 2. The deactivator unit 12 comprises first and second coil parts formed as a first deactivating coil 14 and a second deactivating coil 16, respectively, located in a housing 18. The housing 18 has a cavity 40 with a side section 42 and a bottom section 44. The first and second deactivating coils 14 and 16, each shown as having a square configuration, are positioned in the side section 42 and the bottom section 44, respectively, of the cavity 40 of the housing 18 so as to reside in angular adjacent relation to one another.

Preferably, the first deactivating coil 14 is positioned so that its plane is at an angle in the range of 45° to 135° with respect to the plane of the second deactivating coil 16. As illustrated in FIG. 1, the coils 14 and 16 are positioned adjacent to one another, in approximately orthogonal or 90° relation. The coils 14 and 16, however, are not limited to this angular range, but can be positioned at a variety of different angles depending on the shape of the deactivation zone desired to be formed by the deactivation device 10.

The coils 14 and 16 are adapted to simultaneously transmit their own magnetic fields. In this way, a resultant field is formed from the separate fields of the coils. The resultant field, in turn provides an enhanced mechanism for altering the magnetic properties of an active EAS tag as illustrated in FIG. 3, placed in proximity to the coils.

The power source unit 2 controls the operation of the deactivation unit 12 such that the first and second deactivating coils 14 and 16 are simultaneously energized. The power source is connected to the unit 12 by a cable 32 and comprises an electronics section 7 and a power supply 8.

Figure 2:
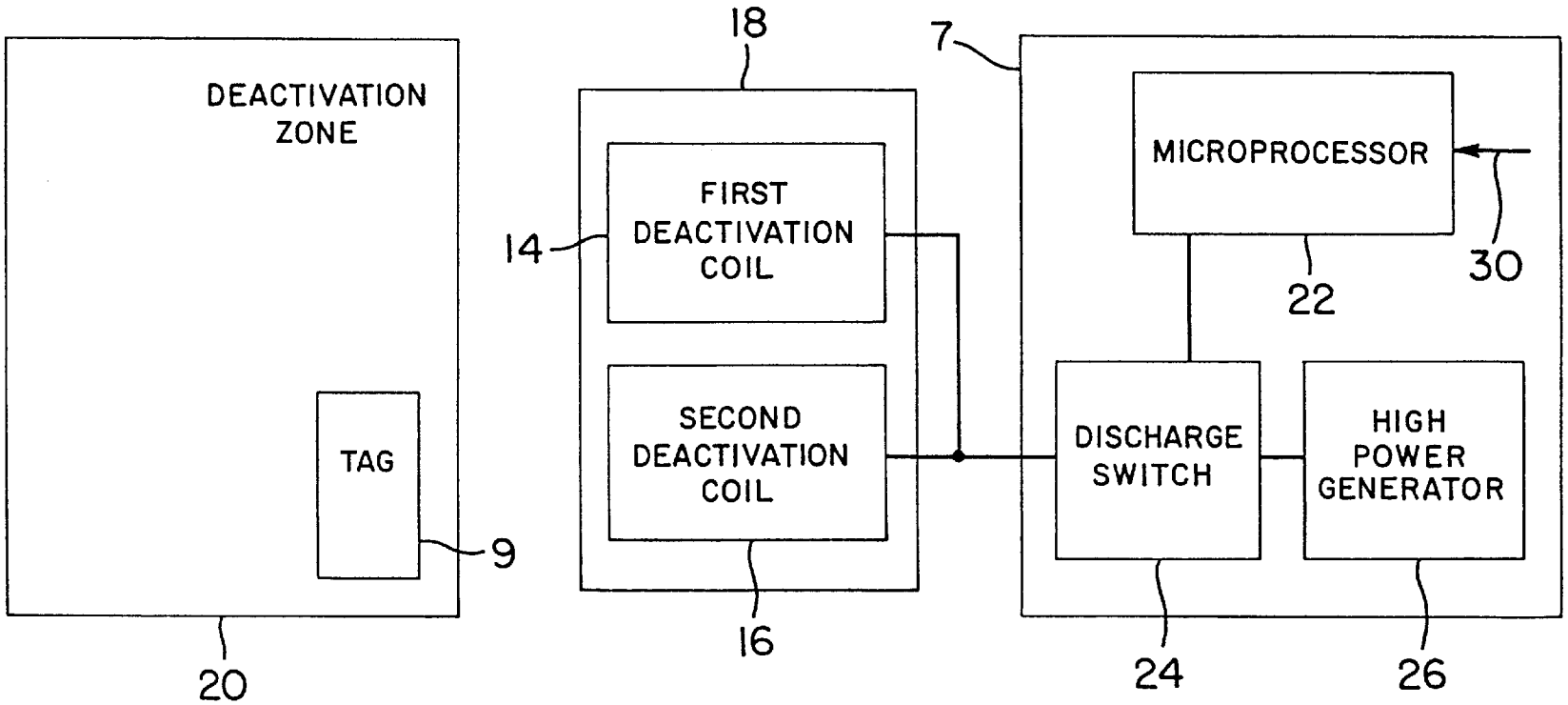
FIG. 2 shows a block diagram of the deactivation device of FIG. 1.

FIG. 2 shows the deactivation device 10 in greater detail in block diagram form. The device 10 defines a deactivation zone 20 in which an EAS tag 9 can be deactivated. FIG. 3 shows a typical EAS tag 9 which can be deactivated by the deactivation device 10.

Figure 3:
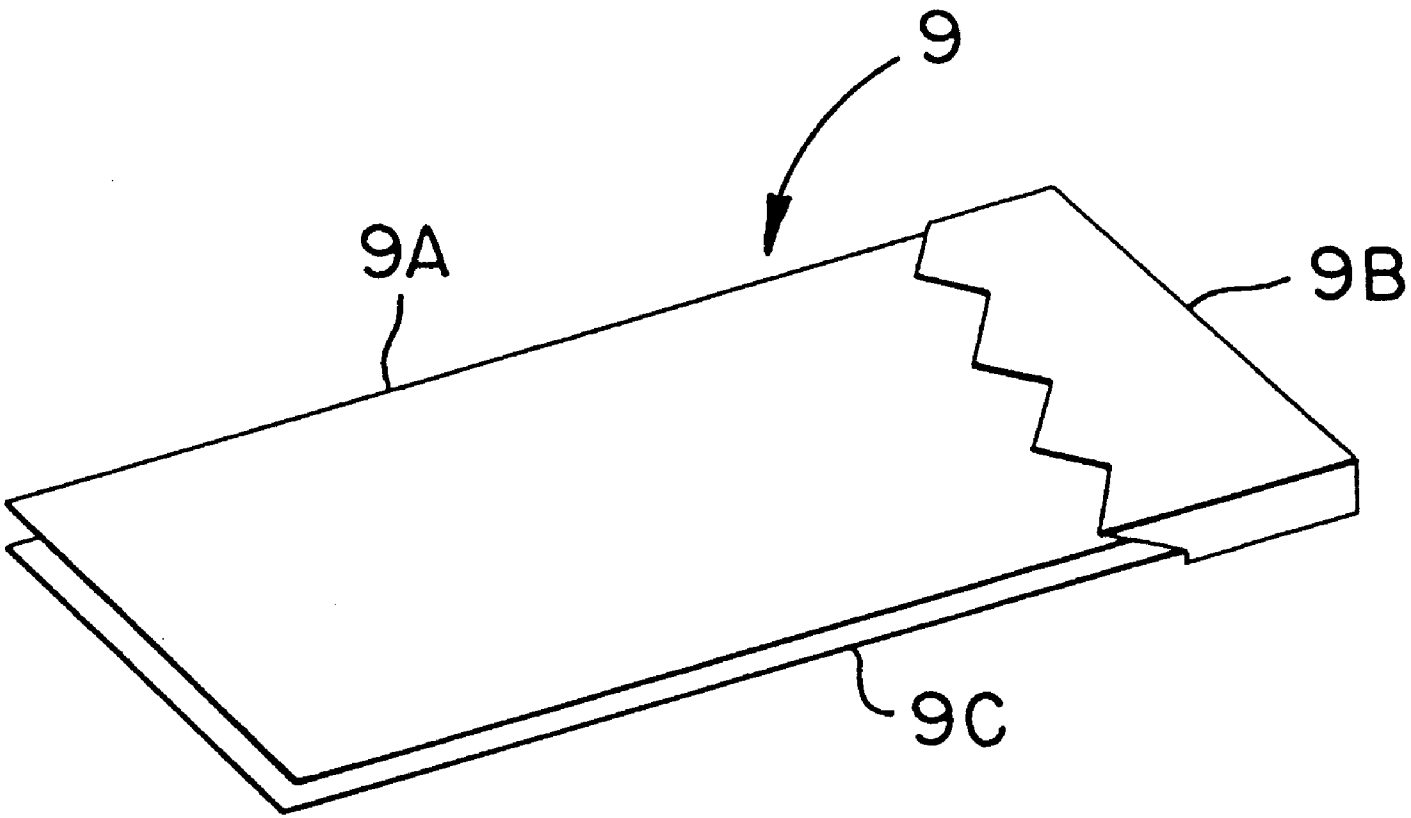
FIG. 3 shows an EAS tag in greater detail for use with the deactivation device of the present invention.

As shown in FIG. 3, the tag 9 comprises a magnetostrictive amorphous element 9A contained in an elongated housing 9B in proximity to a control element 9C which can be comprised of a biasing magnetizable material. Tags of this type are commercially available from assignee, Sensormatic Electronics Corporation of Boca Raton, Fla. under the trademark Ultra*Max®. The characteristics and operation of tags like the deactivatable tag 9 is further described in U.S. Pat. No. 4,510,489 which is incorporated by reference herein.

During operation of the deactivation device 10, a microprocessor 22 receives an input signal over input line 30 indicating that a tag is present at the deactivation device for deactivation. The signal 30 can be generated in a similar fashion as in prior art deactivators, such as the deactivator described in U.S. Pat. No. 5,341,125, the teachings which are incorporated herein by reference. Such deactivators include transmit/receive coils and associated processing circuitry (not shown) for detecting the presence of a tag in the deactivation zone 20 and furnishing the line 30 signal.

Upon receipt of the line 30 signal, the microprocessor 22 initiates a deactivating sequence for the deactivation device 10 by closing a discharge switch 24. This allows the output of a high power generator 26 to be connected to the first and second deactivating coils 14 and 16. A current then flows in the first and second deactivating coils 14 and 16. This causes deactivating electromagnetic fields to be simultaneously transmitted by the coils and a resultant deactivation field is formed in the deactivation zone 20. The resultant deactivation field establishes flux lines along the length of the magnetizable control element 9C of the tag 9, thereby demagnetizing the element.

The resultant deactivation field will cause the element 9C of the tag 9 to be demagnetized regardless of the orientation of the tag with respect to the deactivation device 10 as long as the tag 9 is positioned at a deactivating position within the deactivation zone 20. For example, the deactivation zone 20 created by the deactivation device 10 can exist from the surface of the device 10 out to 8 to 10 inches from the device's surface.

Figure 4A:
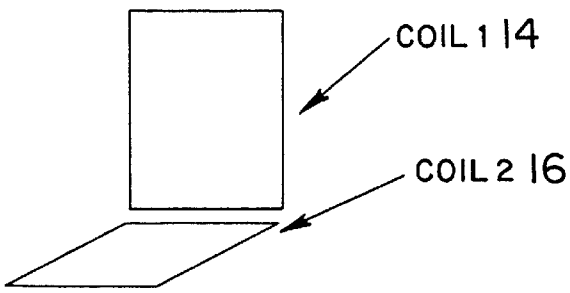
FIGS. 4A–4D show a sample resultant deactivation field of the coils of the deactivation device of FIG. 1.
Figure 4B:
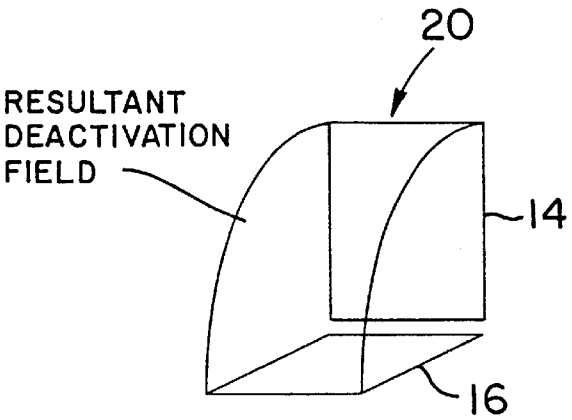

FIGS. 4A–4D show simplified views of the first and second deactivating coils 14 and 16 and a formed resultant deactivation field in the deactivation zone 20 generated by these coils. FIG. 4A shows a general arrangement of the first deactivating coil 14 (coil 1) and the second deactivating coil 16 (coil 2) in adjacent angular orthogonal relation. FIG. 4B shows the configuration of the deactivation zone 20 which results when each coil is generating a magnetic field. In such case, the magnetic fields of the coils vectorally add to create a resultant deactivation field larger than each individual field. The zone 20 defined by the resultant deactivation field helps to create a wider and larger area for deactivating the tag.

Figure 4C:
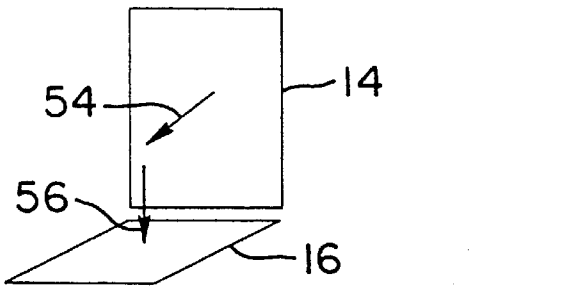
Figure 4D:
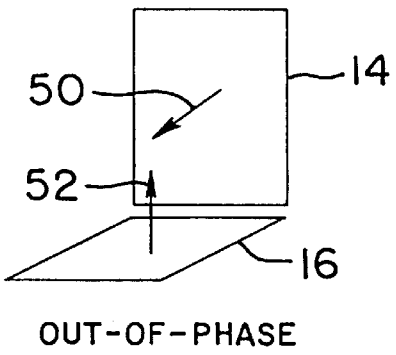

In order to create this larger deactivation zone 20, for example, the first and second deactivating coils 14 and 16 can be energized in-phase, as shown in FIG. 4C, and out-of-phase, as shown in FIG. 4D, in a repetitive fashion. For the in-phase mode, the first and second deactivating coils 14 and 16, as shown in FIG. 4C, have field vectors 54 and 56 coming out of the first deactivating coil 14 and into the second deactivating coil 16, respectively. For the out-of-phase mode, the first and second deactivating coils 14 and 16, as shown in FIG. 4D, have field vectors 50 and 52 coming out of first and second deactivating coils 14 and 16, respectively. The coils 14 and 16 thus cycle in-phase and out-of-phase to help create this larger deactivation zone 20.

Figure 5A:
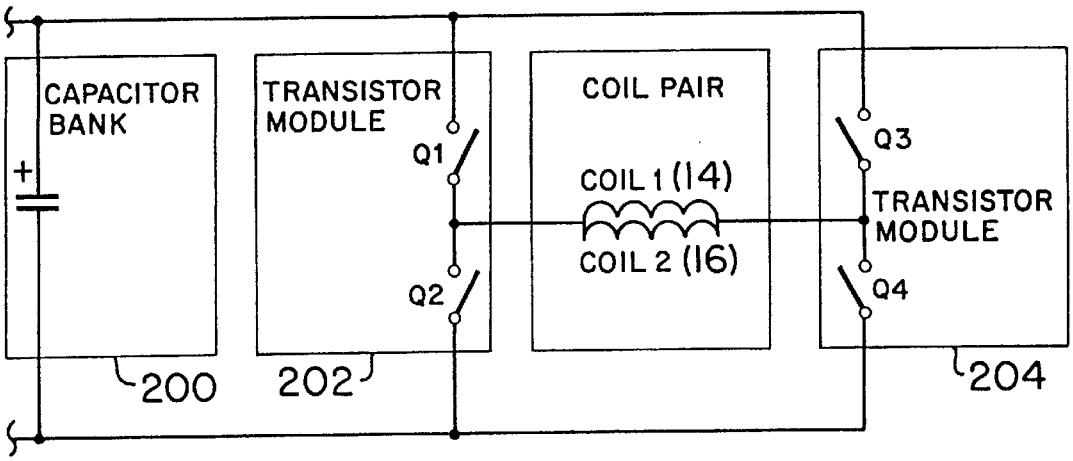
FIGS. 5A–5C show circuit diagrams for various phases of transistors for the deactivation device of FIG. 1.
Figure 5B:
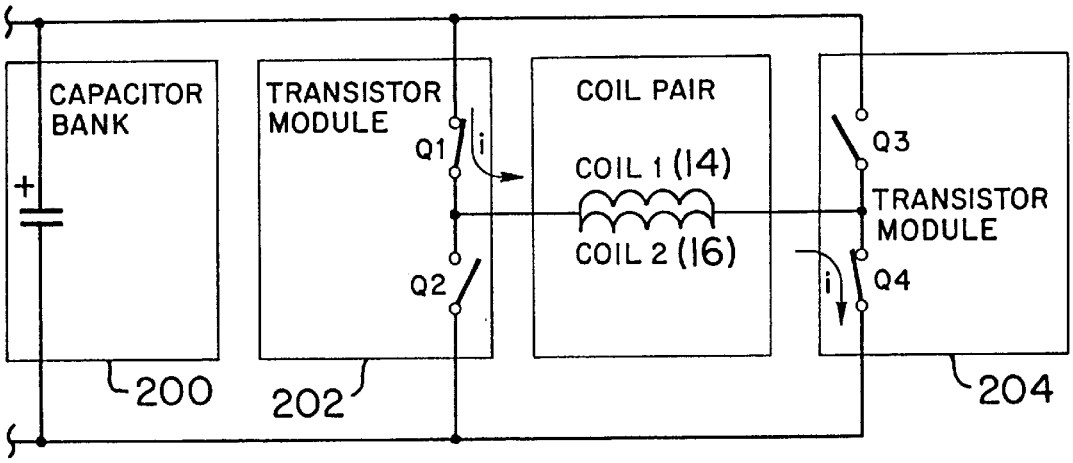
Figure 5C:
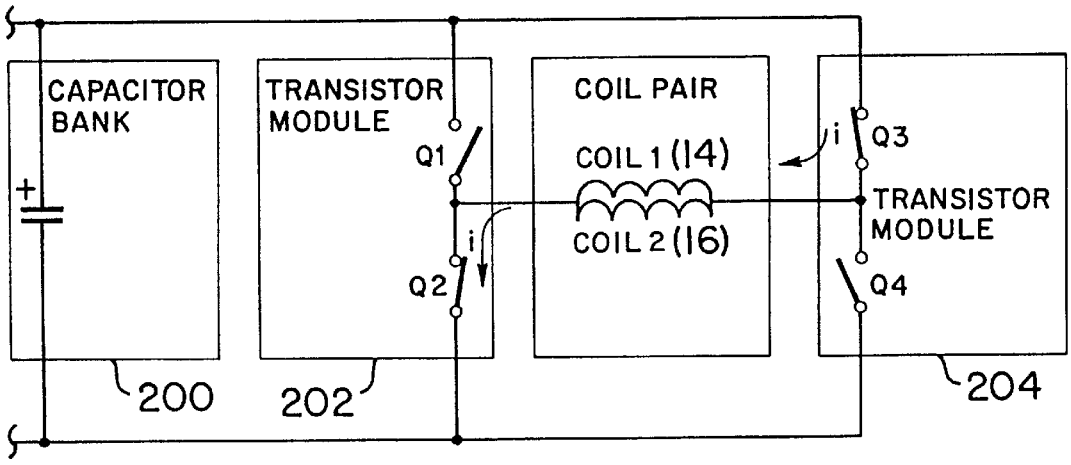

FIGS. 5A–5C illustrate the circuitry for the deactivation device 10 which allows for "cycling" or alternating magnetic fields to be produced in the deactivation zone. The circuit diagrams of FIGS. 5A–5C show four transistors (Q1, Q2, Q3 and Q4) which operate as switches for the deactivation device 10. As shown in FIG. 5A, the transistors are "OFF" as a capacitor bank 200 charges. As shown in FIG. 5B, when the capacitor bank 200 is fully charged, transistors Q1 and Q4 turn "ON" at the same time, placing voltage across coil 14 (coil 1) and coil 16 (coil 2). As the current "i"

ramps up, the first discharge path occurs through the coils thereby allowing for generation of magnetic fields by the coils to form the resultant deactivation field in the deactivation zone 20.

After a designated time period determined by the microprocessor 22, transistors Q1 and Q4 turn "OFF" and transistors Q2 and Q3 turn "ON" as shown in FIG. 5C. The transistors Q2 and Q3 turning "ON" result in a reverse discharge path through the coils thereby reversing the voltage polarity across the coils causing a reversal in the current and the associated magnetic field of each coil. The time between switching is decreased after each successive cycle of the alternating transistor pairs Q1, Q4 and Q2, Q3. This produces the "cycling" or alternating magnetic fields in the deactivation zone 20 of decreasing intensity to allow for deactivation of the tag 9.

Figure 6:
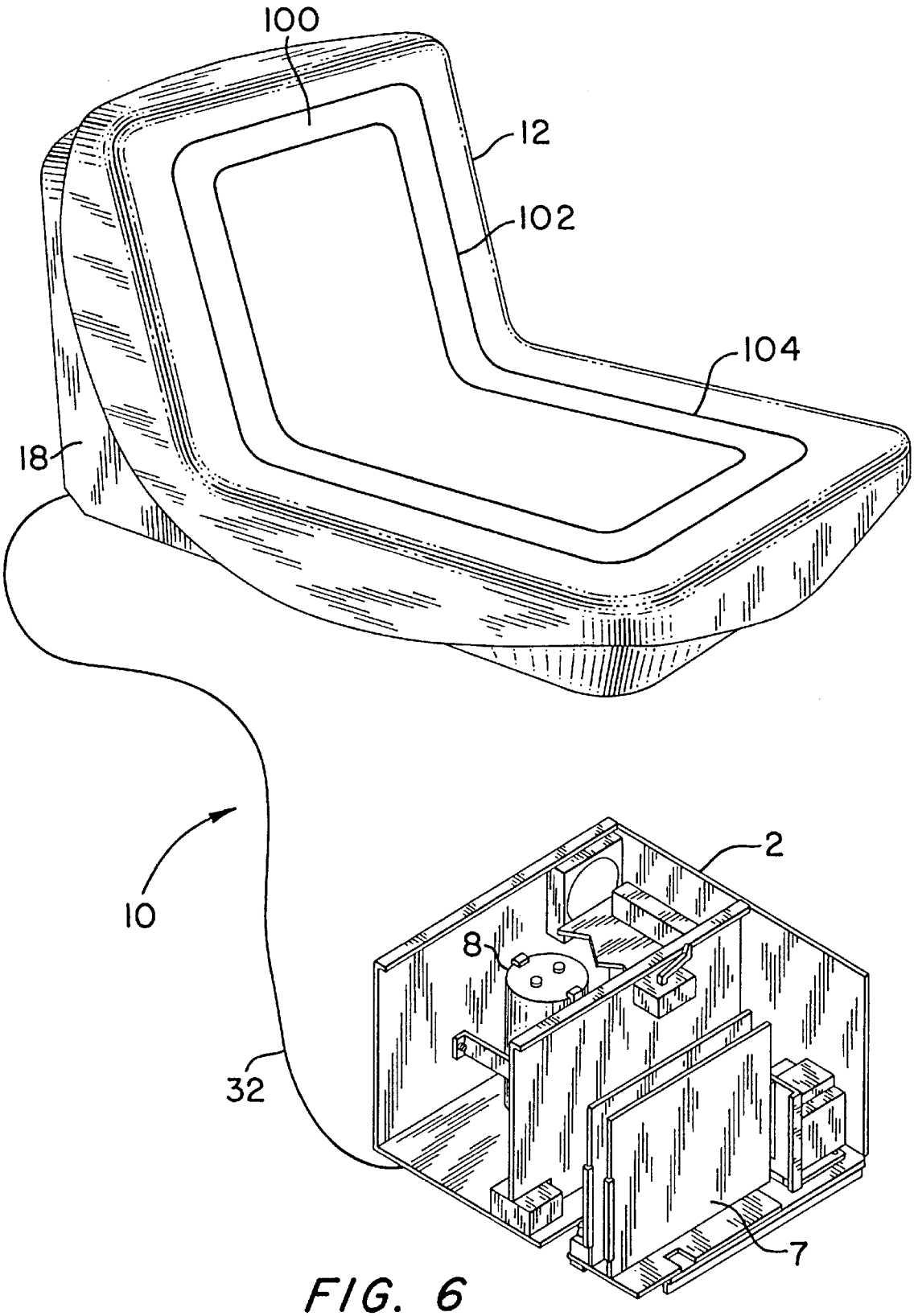
FIG. 6 shows a view of a modified embodiment of the deactivation device of the present invention.

A modified form of the deactivation device 10 is illustrated in FIG. 6. In this case, the device 10 comprises a bent deactivating coil 100 having side and bottom sections 102 and 104 which define the first and second coil parts. An energizing or power source unit 2 drives the coil 100.

Figure 7:
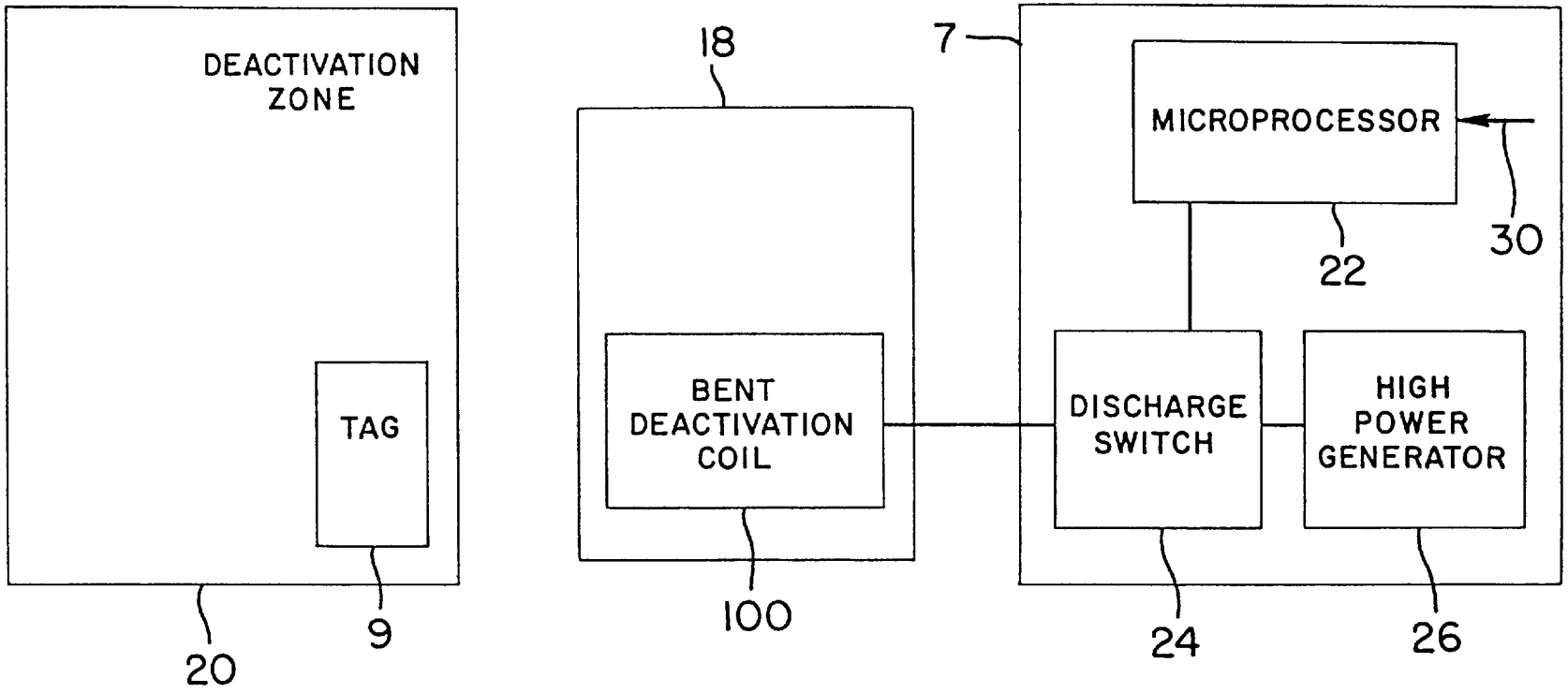
FIG. 7 shows a block diagram of the deactivation device of FIG. 6.

As can be seen in FIG. 6, the coil 100 is bent to form a "bracket" or "L" shape where the side section 102 of the coil 100 is bent at least at a 45° angle with respect to the bottom section 104. The energizing unit 2 energizes the bent deactivating coil 100 to provide a deactivation zone 20, as shown in FIG. 7, similar to that provided by the first and second deactivating coils 14 and 16 of FIGS. 1 and 2. The increased height and area coverage provided by the side and bottom sections 102 and 104 of the bent deactivating coil 100 thus help to produce a larger deactivation zone to permit easier deactivation of the tag 9.

The first and second deactivating coils 14 and 16 of the present invention as shown in FIG. 1 and the bent coil 100 as shown in FIG. 7 are not limited to the configurations as shown, but can be positioned or formed to a variety of different angles depending upon the deactivation zone desired and can also be a variety of shapes, sizes and dimensions. The coils 14 and 16 of FIG. 1 as well as the coil 100 of FIG. 6 can also be manually triggered or operated by any other means which triggers or permits deactivation of a tagged article.

The deactivation device 10 is further not limited for use with the type of tag 9 described above but can be used with a variety of different tags, such as magnetic tags, radio frequency tags, etc., used in electronic article surveillance systems, depending upon the type of coil and phase configuration required.

The housing 12 for the coils can be made of a variety of materials but is preferably injection molded from a non-magnetic material such as polystyrene or polycarbonate. The coils 14 and 16 and coil 100, however, can be incorporated in many different types of housings or supports besides the housing as illustrated in FIGS. 1 and 6 or can operate without such a housing or support. For example, the coils 14 and 16 or coil 100 can be incorporated into a checkout counter or any type of structure in an establishment which requires a deactivation device.

In all cases, it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A deactivation device for use in deactivating electronic article surveillance ("EAS") tags comprising:

a deactivating coil having first and second coil parts, said first coil part positioned in a first plane in angular adjacent relation to said second coil part positioned in a second plane different from the first plane, said deactivating coil being entirely disposed within said first plane and said second plane, said first and second coil parts being adapted to transmit simultaneously a deactivating field, said deactivating field forming a deactivation zone having a configuration which permits for deactivation of an active EAS tag when the active EAS tag is situated within the deactivation zone.

2. A device in accordance with claim 1, wherein the plane of said first coil part is at an angle in the range of 45° to 135° with respect to the plane of the second coil part.

3. A device in accordance with claim 2, wherein the plane of said first coil part is at an angle of 90° with respect to the plane of the second coil part.

4. A device in accordance with claim 2, wherein said deactivation device further comprises a housing for enclosing and holding the first and second coil parts of the deactivating coil.

5. A device in accordance with claim 4, wherein said housing has a cavity with side and bottom sections, said first coil part located in the side section and said second coil part located in the bottom section.

6. A device in accordance with claim 4, wherein said first and second coil parts are formed as first and second separate coils, and said device further comprises an energizing unit for simultaneously energizing said separate coils.

7. A device in accordance with claim 6, wherein said energizing unit energizes said first and second separate coils in-phase and out-of-phase in repetitive fashion.

8. A device in accordance with claim 4, wherein said deactivating coil is a bent coil, said first coil part and said second coil part comprising side and bottom sections, respectively, of the bent coil, and said device includes an energizing unit for energizing said bent coil.

9. A device in accordance with claim 1, wherein said first and second coil parts are formed as first and second separate coils.

10. A device in accordance with claim 9, further comprising an energizing unit for simultaneously energizing said first and second separate coils.

11. A device in accordance with claim 10, wherein said energizing unit energizes said first and second separate coils in-phase and out-of-phase in repetitive fashion.

12. A device in accordance with claim 1, wherein said deactivating coil is a bent coil, said first coil part and said second coil part comprising side and bottom sections, respectively, of the bent coil.

13. A device in accordance with claim 12, further comprising an energizing unit for energizing said bent coil.

14. A method for using a deactivation device to deactivate electronic article surveillance ("EAS") tags comprising the steps of:

placing an active EAS tag at a deactivating position in proximity to the deactivation device;

transmitting a deactivating field simultaneously from first and second coil parts of a deactivating coil of the deactivation device for deactivating an active EAS tag, said first coil part positioned in a first plane in angular adjacent relation to said second coil part positioned in a second plane different from the first plane, said deactivating coil being entirely disposed within said first plane and said second plane; and forming a deactivation zone from the transmission of the deactivating field from the first and second coil parts, said deactivation zone having a configuration which permits for deactivation of the active EAS tag when the active EAS tag is placed at the deactivating position within the deactivation zone.

15. A method in accordance with claim 14, wherein the plane of said first coil part is at an angle in the range of 45° to 135° with respect to the plane of the second coil part.

16. A method in accordance with claim 15, wherein the plane of said first coil part is at an angle of 90° with respect to the plane of the second coil part.

17. A method in accordance with claim 15, wherein said first and second coil parts are formed as first and second separate coils, and said method further comprises the step of simultaneously energizing said separate coils.

18. A method in accordance with claim 17, wherein said energizing step includes energizing said first and second separate coils in-phase and out-of-phase in repetitive fashion.

19. A method in accordance with claim 15, wherein said deactivating coil is a bent coil, said first coil part and said second coil part comprising side and bottom sections, respectively, of the bent coil, and said method further comprises the step of energizing said bent coil.

20. A method in accordance with claim 14, wherein said first and second coil parts are formed as first and second separate coils.

21. A method in accordance with claim 20, further comprising simultaneously energizing said first and second separate coils.

22. A method in accordance with claim 21, wherein said energizing step includes energizing said first and second separate coils in-phase and out-of-phase in repetitive fashion.

23. A method in accordance with claim 14, wherein said deactivating coil is a bent coil, said first coil part and said second coil part comprising side and bottom sections, respectively, of the bent coil.

24. A method in accordance with claim 23, wherein said method further comprises the step of energizing said bent coil.

25. A system for using a deactivation device to deactivate electronic article surveillance ("EAS") tags, comprising:

a) an EAS active tag; and b) a deactivating coil for deactivating the active EAS tag, said deactivating coil having first and second coil parts, said first coil part positioned in a first plane in angular adjacent relation to said second coil part positioned in a second plane different from the first plane, said deactivating coil being entirely disposed within said first plane and said second plane, said first and second coil parts being adapted to transmit simultaneously a deactivating field, said deactivating field forming a deactivation zone having a configuration which permits for deactivation of the active EAS tag when the active EAS tag is situated within the deactivation zone.

26. A system in accordance with claim 25, wherein the plane of said first coil part is at an angle in the range of 45° to 135° with respect to the plane of the second coil part.

27. A system in accordance with claim 26, wherein the plane of said first coil part is at an angle of 90° with respect to the plane of the second coil part.

28. A system in accordance with claim 26, wherein said first and second coil parts are formed as first and second separate coils, and said device further comprises an energizing unit for simultaneously energizing said separate coils.

29. A system in accordance with claim 28, wherein said energizing unit energizes said first and second separate coils in-phase and out-of-phase in repetitive fashion.

30. A system in accordance with claim 26, wherein said deactivating coil is a bent coil, said first coil part and said second coil part comprising side and bottom sections, respectively, of the bent coil, and said device includes an energizing unit for energizing said bent coil.

31. A system in accordance with claim 25, wherein said first and second coil parts are formed as first and second separate coils.

32. A system in accordance with claim 31, wherein said device further comprises an energizing unit for simultaneously energizing said first and second separate coils.

33. A system in accordance with claim 32, wherein said energizing unit energizes said first and second separate coils in-phase and out-of-phase in repetitive fashion.

34. A system in accordance with claim 25, wherein said deactivating coil is a bent coil, said first coil part and said second coil part comprising side and bottom sections, respectively, of the bent coil.

35. A system in accordance with claim 34, wherein said device further comprises an energizing unit for energizing said bent coil.

36. A deactivation device for use in deactivating electronic article surveillance ("EAS") tags comprising:

a deactivating coil having first and second coil parts formed as first and second separate coils, said first coil positioned in angular adjacent relation to said second coil, said first and second coils being adapted to transmit simultaneously a deactivating field, said deactivating field forming a deactivation zone having a configuration which permits for deactivation of an active EAS tag when the active EAS tag is situated within the deactivation zone.

37. A device in accordance with claim 36, further comprising an energizing unit for simultaneously energizing said first and second separate coils.

38. A device in accordance with claim 37, wherein said energizing unit energizes said first and second separate coils in-phase and out-of-phase in repetitive fashion.

39. A method for using a deactivation device to deactivate electronic article surveillance ("EAS") tags comprising the steps of:

placing an active EAS tag at a deactivating position in proximity to the deactivation device;

transmitting a deactivating field simultaneously from first and second coil parts of a deactivating coil of the deactivation device for deactivating an active EAS tag, said first and second coil parts formed as first and second separate coils, said first coil positioned in angular adjacent relation to said second coil; and forming a deactivation zone from the transmission of the deactivating field from the first and second coils, said deactivation zone having a configuration which permits for deactivation of the active EAS tag when the active EAS tag is placed at the deactivating position within the deactivation zone.

40. A method in accordance with claim 39, further comprising simultaneously energizing said first and second separate coils.

41. A method in accordance with claim 40, wherein said energizing step includes energizing said first and second separate coils in-phase and out-of-phase in repetitive fashion.

42. A system for using a deactivation device to deactivate electronic article surveillance ("EAS") tags, comprising:

a) an EAS active tag; and b) a deactivating coil for deactivating the active EAS tag, said deactivating coil having first and second coil parts and formed as first and second separate coils, said first coil positioned in angular adjacent relation to said second coil, said first and second coils being adapted to transmit simultaneously a deactivating field, said deactivating field forming a deactivation zone having a configuration which permits for deactivation of the active EAS tag when the active EAS tag is situated within the deactivation zone.

43. A system in accordance with claim 42, wherein said device further comprises an energizing unit for simultaneously energizing unit energizing said first and second separate coils.

44. A system in accordance with claim 43, wherein said energizing unit energizes said first and second separate coils in-phase and out-of-phase in repetitive fashion.

* * * * *